US008382549B2

(12) United States Patent
Shishido

(10) Patent No.: US 8,382,549 B2
(45) Date of Patent: Feb. 26, 2013

(54) WHISTLE

(76) Inventor: Hideomi Shishido, Hiroshima (JP)

( * ) Notice: Subject to any disclaimer, the term of this patent is extended or adjusted under 35 U.S.C. 154(b) by 261 days.

(21) Appl. No.: 12/738,801

(22) PCT Filed: Oct. 19, 2007

(86) PCT No.: PCT/JP2007/070872

§ 371 (c)(1),
(2), (4) Date: Apr. 19, 2010

(87) PCT Pub. No.: WO2009/050827

PCT Pub. Date: Apr. 23, 2009

(65) Prior Publication Data

US 2010/0261403 A1 Oct. 14, 2010

(51) Int. Cl.
*A63H 5/00* (2006.01)

(52) U.S. Cl. ..... 446/204; 446/202

(58) Field of Classification Search ..... 446/202–208; 116/137 R

See application file for complete search history.

(56) References Cited

U.S. PATENT DOCUMENTS

| | | | | |
|---|---|---|---|---|
| 2,551,367 | A * | 5/1951 | Fahey | 84/380 R |
| 3,066,443 | A * | 12/1962 | Mobley | 446/204 |
| 5,546,887 | A * | 8/1996 | Cameron | 116/137 R |
| 5,564,360 | A * | 10/1996 | Wright | 116/137 R |
| 6,837,177 | B2 * | 1/2005 | Tanaka | 116/137 R |
| 8,006,634 | B2 * | 8/2011 | Shishido | 116/137 R |

FOREIGN PATENT DOCUMENTS

| | | | |
|---|---|---|---|
| JP | 1-207796 | A | 8/1989 |
| JP | 8-278787 | A | 10/1996 |
| JP | 9-212171 | A | 8/1997 |
| JP | 2002-41049 | A | 2/2002 |
| JP | 2003-330452 | A | 11/2003 |
| JP | 2007-114638 | A | 5/2007 |

OTHER PUBLICATIONS

International Search Report for International application No. PCT/JP2007/070872 with English translation mailed Feb. 12, 2008.
Notification of Reasons for Rejection for Japanese Patent Application No. 2009-537866, mailed Jun. 26, 2012, with English translation.

* cited by examiner

*Primary Examiner* — Nini Legesse
(74) *Attorney, Agent, or Firm* — Cantor Colburn LLP

(57) ABSTRACT

There is provided a whistle which suppresses any delay of sound to a listener and any attenuation of a sound volume, can transmit sound waves directly, can be blown with various tones, and has a large sound volume. Two kinds of whistles are stacked up and down and integrated together as a single whistle, an orifice is formed opposite to an air feeding opening to transmit sound waves directly to a listener. Moreover, an amount of air flowing into each air feeding tube of the whistle is controlled depending on an angle of putting a mouthpiece in a mouth to select a tone. A tone selecting member or an air amount adjusting flap is provided, and tone can be selected by mechanically blocking off each air feeding tube. Furthermore, an air amount adjusting flap which changes an air-feeding-path cross-sectional area of the air feeding opening, the air feeding tube, or the orifice is provided, and a sound volume can be changed by adjusting an amount of passing air.

5 Claims, 9 Drawing Sheets

EFFECTIVE AIR-SUPPLY AREA OF PRESENT INVENTION ($90mm^2$)

- ADULT MALE
- ADULT FEMALE
- CHILD AND ELDER PERSON

EFFECTIVE AIR-SUPPLY AREA OF CONVENTIONAL WHISTLE ($45mm^2$)

- ADULT MALE
- ADULT FEMALE
- CHILD AND ELDER PERSON

WHISTLE

CROSS REFERENCE TO RELATED APPLICATIONS

This is a U.S. national stage application of International Application No. PCT/JP2007/070872, filed on 19 Oct. 2007.

TECHNICAL FIELD

The present invention relates to a whistle used for sports, rescuing, dogs, or coaching. More specifically, the present invention relates to a whistle which has a mechanical-oscillator whistle and a non-oscillator whistle stacked with each other in the vertical direction, can directly transmit sound to a listener, and can be blown while changing a tone, and a whistle which enables adjustment of the amount of blown air into a resonant chamber depending on the breathing capacities of adult males, females, and children, respectively.

BACKGROUND ART

Whistles are widely used as means for transmitting various pieces of information to a person or an animal far away quickly, inexpensively, and simply using the breath of a human without any electrical or mechanical complex mechanism. As is clear from the purpose thereof, the most important functions required for whistles are to blow discriminative tone which can be distinguished from other sounds and to be blown at a sound volume as large as possible.

It is well known that the whistles have the same blow principle as those of wind instruments. That is, the frequency (tone) of whistle sound is set based on the shape and the size of a resonant chamber, and the sound volume (magnitude of sound) is set based on an amount of air (airflow) to be blown in. In contrast, whistles as commercial products have advancement in the manufacturing method thereof based on the advancement of materials and machines, but have no large advancement in the principle ever since the original model was made in late 1800s. The structure of whistles can be classified into two kinds.

First one is that a mechanical oscillator like a cork is put in a resonant chamber formed in a short-cylindrical shape, and beat sound is generated by the turning motion of the oscillator due to exhaled breath and resonance, and this structure is the most popular structure because blowing is easy. Hereinafter, this is called an oscillator whistle.

Another is one which does not use a mechanical oscillator, and is configured by a plurality of tiny resonant rooms (hereinafter, a collection of plural tiny resonant rooms is called a composite resonant room) each formed in a single or plural long cylindrical shapes, and orifices. This structure requires a certain level of proficiency to blow, and is mainly used for sport referees. This structure is called a non-oscillator whistle.

Next, an explanation will be given of the present situation and the problem in detail relating to the foregoing two requisite performances (discriminative tone and sound volume). First, regarding the tone, because the practical shape of a resonant room and the size thereof are limited, the blown frequency is thus limited. More specifically, the frequency of an oscillator whistle is 2.5 to 3.5 KHz, and that of a non-oscillator whistle is 3.5 to 4.5 KHz. As is clear from those numerical data, the whistle sound of the oscillator whistles is low, and is called a "low-pitched sound type" in some cases. In contrast, the whistle sound of the non-oscillator type is high, and is called a "high-pitched sound type" in some cases, and both whistles are used selectively depending on the kinds of sporting events and the use environments.

Whistles used ordinary have a size in a mouthpiece end (air-supply end) formed by the width (15 to 24) mm multiplied by the height (6 to 9) mm and the length without a strap hole (42 to 55) mm. Accordingly, the range of the foregoing frequency further becomes narrow, it is difficult to distinguish tones among the same whistles, so that it brings about various problems. A noticeable example of such problems is that a plurality of same or different sporting events are simultaneously carried out at the same site. For example, in the case of basketball, games are simultaneously carried out at two courts or three courts in the same floor. In basketball games, it is often that whistles are blown to judge fouls properly, so that it is possible to hear the whistle sounds at an adjoining court, and the whistle sounds may be misrecognized, and often resulting in interruption of a game. Therefore, it is necessary for players to always pay attention whether or not a whistle sound is in their court, resulting in interruption of concentration to the game. Moreover, misrecognition may cause a trouble, and the game itself may become in a tangle. The same is true of other indoor sports, such as valley ball and a hand ball.

There is only one solution so far to use whistles having different tones (blown frequencies) in order to overcome the foregoing problem. Accordingly, referees are required to have different kinds of and a plurality of whistles, and it is confirmed in a meeting prior to a game that whistles having similar tones will not be used. In practice, however, it is not always true that a referee has a sufficient number of whistles for selection of tones, so that the foregoing problem remains unsolved yet.

So far, there are several proposes as techniques of realizing discriminative tone. The most popular technique is to utilize beat sound. Typical examples of such technique can be seen in U.S. Pat. No. 5,086,726 or U.S. Pat. No. 4,821,670. Both are non-oscillator whistles having three tiny resonant chambers with different lengths, i.e., a composite resonant chamber. The former has the three tiny resonant chambers each formed in a rectangular shape with a different length and arranged in the horizontal direction, while the latter has the two tiny resonant chambers among the three tiny resonant chambers, formed in a long-cylindrical shape with different lengths, and arranged at both sides of a top face, and also has the remaining one arranged at the center of the bottom face. Both whistles have the tiny resonant chamber with a length of 16 mm to 25 mm. According to both whistles, blown air flows through an air feeding tube commonly communicated with individual tiny resonant chambers (hereinafter, common air feeding tube), flows through individual air feeding tubes, and is fed in individual tiny resonant chambers, thereby generating resonance. The reason why the common air feeding tube is long (9 to 10 mm) is to suppress any nonuniform feeding of air into individual resonant chambers. Each resonance has a slightly different frequency, so that beat sound is generated which is well known conventionally. However, because individual tiny resonant chambers are not independent from one another, it is not possible to blow the resonant chambers individually, and the three tiny chambers work together as a single composite resonant chamber, resulting in a function as a single whistle. Accordingly, there is generated beat sound, but the tone thereof is fixed and single one, and it is not possible to blow the whistle while changing the tone. Therefore, in comparison with non-oscillator types having no beat sound, the tone differs, but there is no large difference in tones among whistles having beat sound because of the similar lengths of tiny resonant chambers.

Another interesting proposal is disclosed in Japanese Utility Model Application KOKAI Publication No. S60-49598. This propose utilizes the principle of open tube/close tube of wind instruments which is well known conventionally, and the resonant frequency is changed by forming an opening in a part of the wall of the resonant chamber in addition to an orifice. Furthermore, according to this disclosure, in addition to the foregoing propose, there is another propose that two resonant chambers having different lengths and air feeding tubes connected thereto respectively are arranged symmetrically in the horizontal direction. However, it is difficult to individually blow each of the two air feeding tubes arranged in the horizontal direction from the standpoint of a structure that the mouth cavity of a human is long in the horizontal direction, so that there is a problem that it is not possible to separately blow two different whistle sounds using a single whistle.

Moreover, forming an air exhaust port in addition to an orifice produces air leak, so that it is not possible for a person having a small breathing capacity, such as a child or an elder person to blow the whistle because he/she becomes hard to breathe. Unexamined Japanese Patent Application KOKAI Publication No. H07-64562 discloses a similar propose to the foregoing one, but the same is true in regard to this problem.

Conversely, regarding the sound volume, there is no whistle so far which can generate remarkably large sound. This is because the blow principle is same and the size is limited within a narrow range, so that it is difficult to find a new concept, and as far as it stands, an air feeding amount is increased or decreased as needed. The typical area of air feeding opening of the conventional whistles is 38 to 45 $mm^2$ regardless of the oscillator type and the non-oscillator type. This is a size set with a view to enable most people including females and children to blow the whistle without becoming hard to breathe.

The sound volume of whistle sound of whistles is proportional to an air feeding amount per unit time (V), and the stronger a whistle is blown, the more the air feeding amount per unit time increases, resulting in increasing of the sound volume. Conversely, the breathing capacity of a man (L) is limited, so that it is not possible to keep blowing without limitation, and a whistling continuous time (T) is inversely proportional to the air feeding amount per unit time. That is, a relational expression that $L=V\times T$ is concluded.

As a specific example, in the case of an adult male, the average breathing capacity is 4000 cc, when the same male blow a typical oscillator whistle most strongly, i.e., the continuous time of the maximum sound volume is about 7 seconds, and as a result, the air feeding amount per unit time at the maximum sound volume (maximum air feeding amount per unit time) becomes 571 cc/sec. As is clear from this result, there is a close relation between the maximum sound volume and the maximum air feeding amount per unit time.

If a whistling person remains same, the maximum air feeding amount per unit time is set based on the size of an air feeding opening, the size, shape, and length of an air feeding tube, and the size of an orifice. According to conventional whistles, however, because those are all fixed, the maximum air feeding amount per unit time is also fixed and cannot be changed. That is, the maximum sound volume is thus fixed, and it is not possible to blow a whistle with a sound volume louder than the fixed maximum sound volume.

The only specific solution so far which can generate large sound and which is commercially available is a whistle having an increased whole size thereof, but females and children having little breathing capacity may have difficulty to breathe, so that not all people can use such a whistle, and it is not practical solution.

One of another reason why the sound volume is insufficient is that the orifices of conventional whistles are all opened upwardly (toward the top face direction). Because a listener is positioned in the front direction in most cases, whistle sound is once directed upwardly, and sound waves which reflect a ceiling or a wall reaches such a listener. As is conventionally well known, the sound volume is inversely proportional to the square of distance, so that reaching sound waves are unnecessarily attenuated.

Furthermore, because reflected wave has a longer propagation distance, a time until the wave reaches becomes long. As an example, the speed of sound propagating in air is m/sec, so that when a reflective reaching distance is m, it takes about seconds, and this is normegligible for a sport referee who uses a whistle and needs an instant judgment.

DISCLOSURE OF INVENTION

The present invention provides a whistle which comprises: a first whistle including a first resonant chamber, a first air feeding tube for feeding air into the first resonant chamber, and a first orifice; a second whistle including a second resonant chamber, a second air feeding tube for feeding air into the second resonant chamber, an oscillator put in the second resonant chamber, and a second orifice; and an air feeding opening for feeding air into the first air feeding tube and the second air feeding tube, wherein the first whistle and the second whistle are arranged up and down and integrated together regardless of a positional relationship so as to stack the first air feeding tube and the second air feeding tube up and down to form a mouthpiece, and at least one of the first orifice and the second orifice is opened toward an opposite side to the air feeding opening.

The present invention also provides a whistle which comprises: a first whistle including a first resonant chamber, a first air feeding tube for feeding air into the first resonant chamber, an oscillator put in the first resonant chamber, and a first orifice; a second whistle including a second resonant chamber, a second air feeding tube for feeding air into the second resonant chamber, an oscillator put in the second resonant chamber, and a second orifice; and an air feeding opening for feeding air into the first air feeding tube and the second air feeding tube, wherein the first resonant chamber and the second resonant chamber have different volumes from each other, the first whistle and the second whistle are arranged up and down and integrated together regardless of a positional relationship, and at least one of the first orifice and the second orifice is opened toward an opposite side to the air feeding opening.

According to the present invention, a resonant-chamber-body axis interconnecting the first resonant chamber and the second resonant chamber is inclined relative to a mouthpiece axis of a mouthpiece parallel to the first air feeding tube and the second air feeding tube, and the first resonant chamber is located at the air feeding opening side to form the mouthpiece in a concaved shape, thereby causing the mouthpiece to function as a stopper against a lip.

According to the present invention, an amount of air flowing into the first air feeding tube and the second air feeding tube is controlled depending on an angle of putting a mouthpiece including the first air feeding tube and the second air feeding tube into a mouth to select tone.

According to the present invention, the whistle further comprises a tone selecting member which is detachable and which blocks off the first air feeding tube or the second air feeding tube, wherein tone is selected by causing the tone selecting member to block off air flowing into either one of the first air feeding tube and the second air feeding tube.

According to the present invention, the whistle further comprising an air amount adjusting flap which changes air-supply cross-sectional areas of the first air feeding tube and the second air feeding tube to control an amount of air flowing into the first air feeding tube and the second air feeding tube.

Furthermore, the present invention also provides a whistle which comprises: a resonant chamber; an air feeding tube for feeding air into the resonant chamber; an orifice; an air feeding opening; and air amount control means which changes an amount of air passing through the air feeding tube, the orifice, or the air feeding opening to change a sound volume.

According to the present invention, the whistle further comprises an air amount adjusting flap which is the air amount control means that changes an air-supply cross-sectional area of the air feeding tube, and a sound volume is changed by controlling an amount of air flowing into the resonant chamber.

BEST MODE FOR CARRYING OUT THE INVENTION

Figure 1:
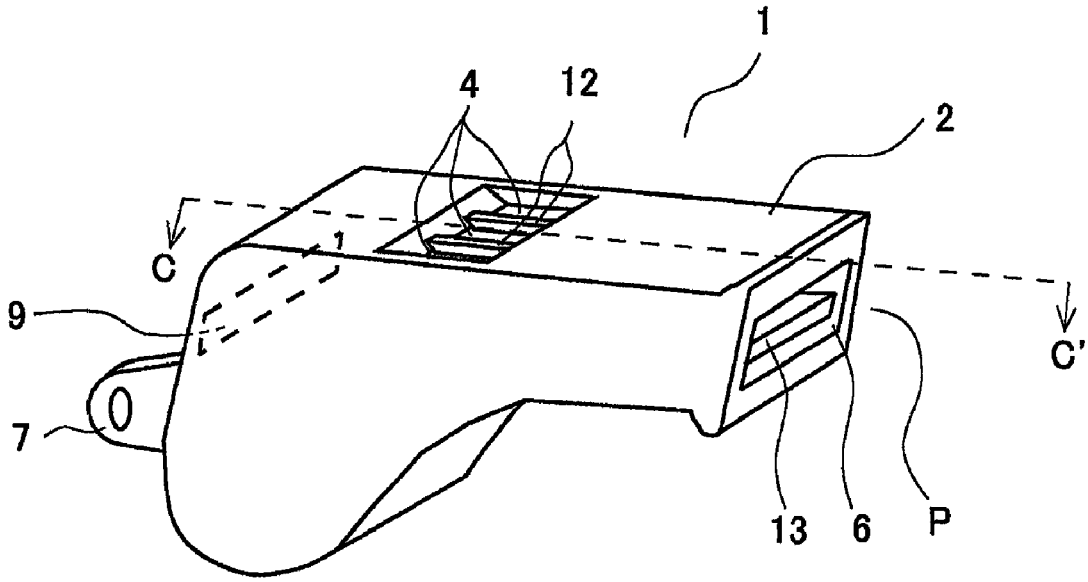
FIG. 1 is a perspective view showing a whistle of the present invention.
Figure 2:
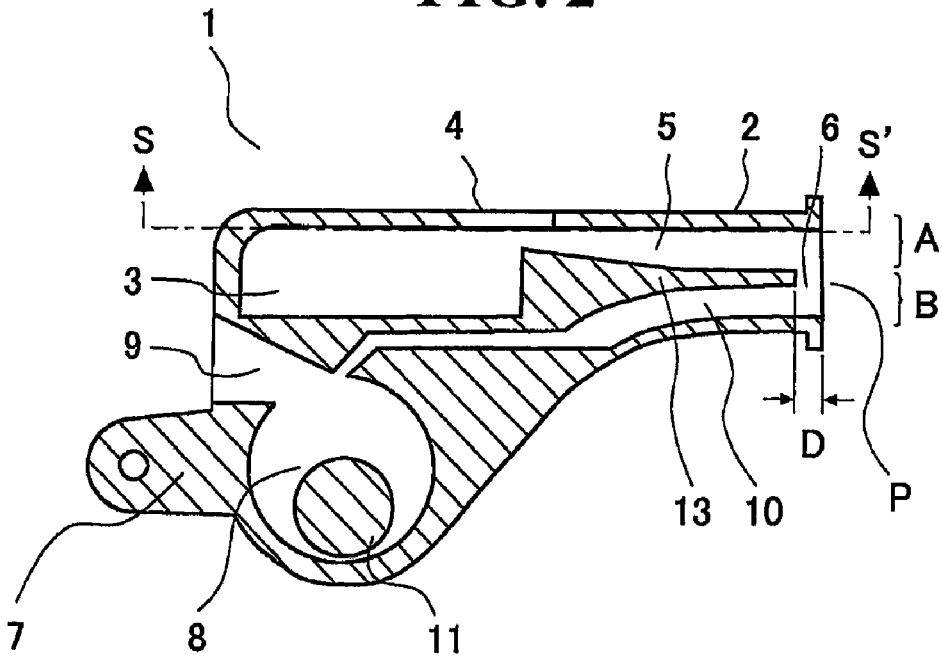
FIG. 2 is a cross-sectional view of the whistle of the present invention.
Figure 3:
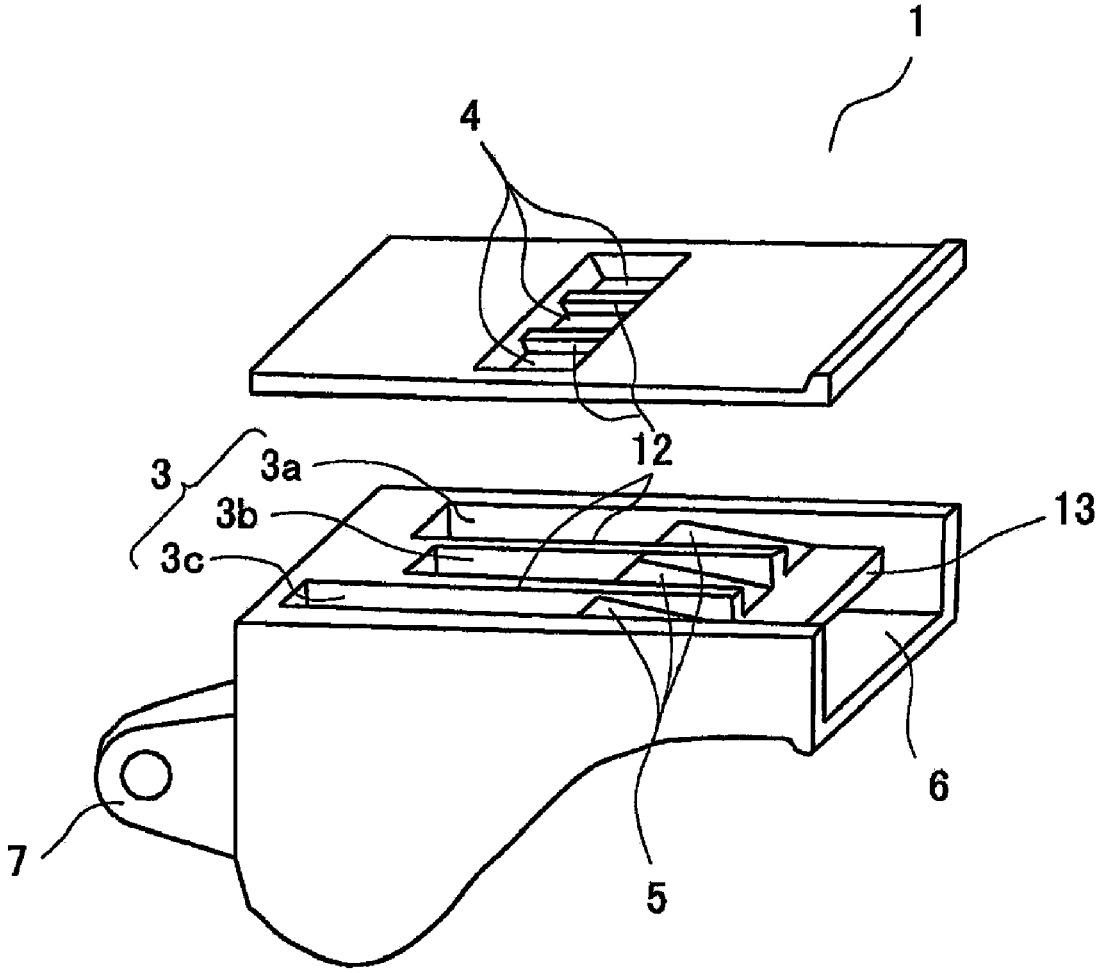
FIG. 3 is an exploded perspective view of the whistle of the present invention.

FIGS. 1 and 2 respectively show an external appearance of a simplest and basic whistle 1 of the present invention according to a first embodiment, and a C-C' cross section thereof. FIG. 3 draws an inner surface of an upper whistle A cut along an S-S' surface in FIG. 2.

The whistle 1 of the first embodiment employs a two-layer structure that two independent first whistle A and second whistle B spaced apart by a partition wall 13 are stacked in the vertical direction and integrated together.

The first whistle A is a non-oscillator whistle comprising a first resonant chamber (upper resonant chamber) 3 which is a composite resonant chamber including rectangular tiny resonant chambers 3*a*, 3*b*, and 3*c* having different lengths spaced apart by respective partition walls first orifices 4 divided by respective partition walls 12 correspondingly to the respective tiny resonant chambers 3*a*, 3*b*, and 3*c* and opened upwardly, and a first air feeding tube 5. The respective lengths of the tiny resonant chambers 3*a*, 3*b*, and 3*c* can be the same lengths as those of the conventional ones, and for example, are mm, 19 mm, and 20 mm, respectively.

Conversely, the second whistle B is provided below the first whistle A, and is an oscillator whistle which comprises a short-cylindrical second resonant chamber 8, a mechanical oscillator 11 encapsulated therein, a second orifice opened in the back direction (front of a user) of the whistle 1, and a second air feeding tube The size of the second resonant chamber 8 can be set to be same as that of conventional one, e.g., a diameter of 15 mm and a length of 18 mm. The second orifice 9 is provided opposite to an air feeding opening P, so that whistle sound can be propagated to a listener efficiently in a short time. Because sound can be directly propagated, it is effective especially for a sport game that whistle sound must be transmit to a player instantaneously. Moreover, because sound is directly transmitted, attenuation of sound volume can be suppressed, thereby enabling propagation of large whistle sound.

Reference numeral 2 is a mouthpiece, and reference numeral 7 is a holder for attaching a strap. The mouthpiece 2 is put into a mouth when blown, and includes the first air feeding tube 5 and the second air feeding tube Moreover, reference numeral 6 is a common air feeding tube to feed air into the first and second air feeding tubes 5, 10 stacked in the vertical direction, and it is desirable that a length D thereof should be 0 to 7 mm. This is because if the length exceeds 7 mm, it becomes difficult to control the amount of air fed in respective first and second air feeding tubes 5, 10 in accordance with how to put the mouthpiece in a mouth as will be discussed later. Note that the air feeding opening P can have a size that the height is to 6.0 mm, and a width is 15 to 20 mm. Accordingly, the external size of the mouthpiece 2 can be 6 to 8 mm in height and 17 to 22 mm in width, and this size is substantially same as the size of a conventional whistle, so that it is not difficult to put the mouthpiece in a mouth. Moreover, because the effective size (an area through which air passes) thereof is also substantially same as a conventional whistle, it is not difficult for females and children to breathe, and is easy to blow like conventional whistles. The total length of the foregoing structure without the holder 7 is 40 to 45 mm which is same as that of a conventional whistle. The whistle 1 of the first embodiment is made by a method of producing individual parts through a conventional injection molding technique using a plastic material, e.g., an ABS resin, and of joining those parts together by ultrasonic welding or by means of a bond. This is a conventionally well known technique, so that explanation thereof will be omitted.

According to such a structure, as air is fed through the air feeding opening P, the fed air passes through the common air feeding tube 6, enters into the first and second resonant chambers 3, 8, through the first and second air feeding tubes 5, 10, respectively, and ejected from the first and second orifices 4, 9 together with whistle sound, thereby causing the upper and lower two first and second whistles A, B to generate sound simultaneously. The whistle sound includes both high pitch sound and low pitch sound as explained above, and two different kinds of sounds are mixed, so that nonconventional tone is generated. In addition, because the orifices 4, 9 are opened upward and frontward, respectively, not reflective wave but direct wave reaches a listener in a wide range subjected to transmission of whistle sound, so that it is transmitted with a large sound volume in the shortest time.

Figure 4:
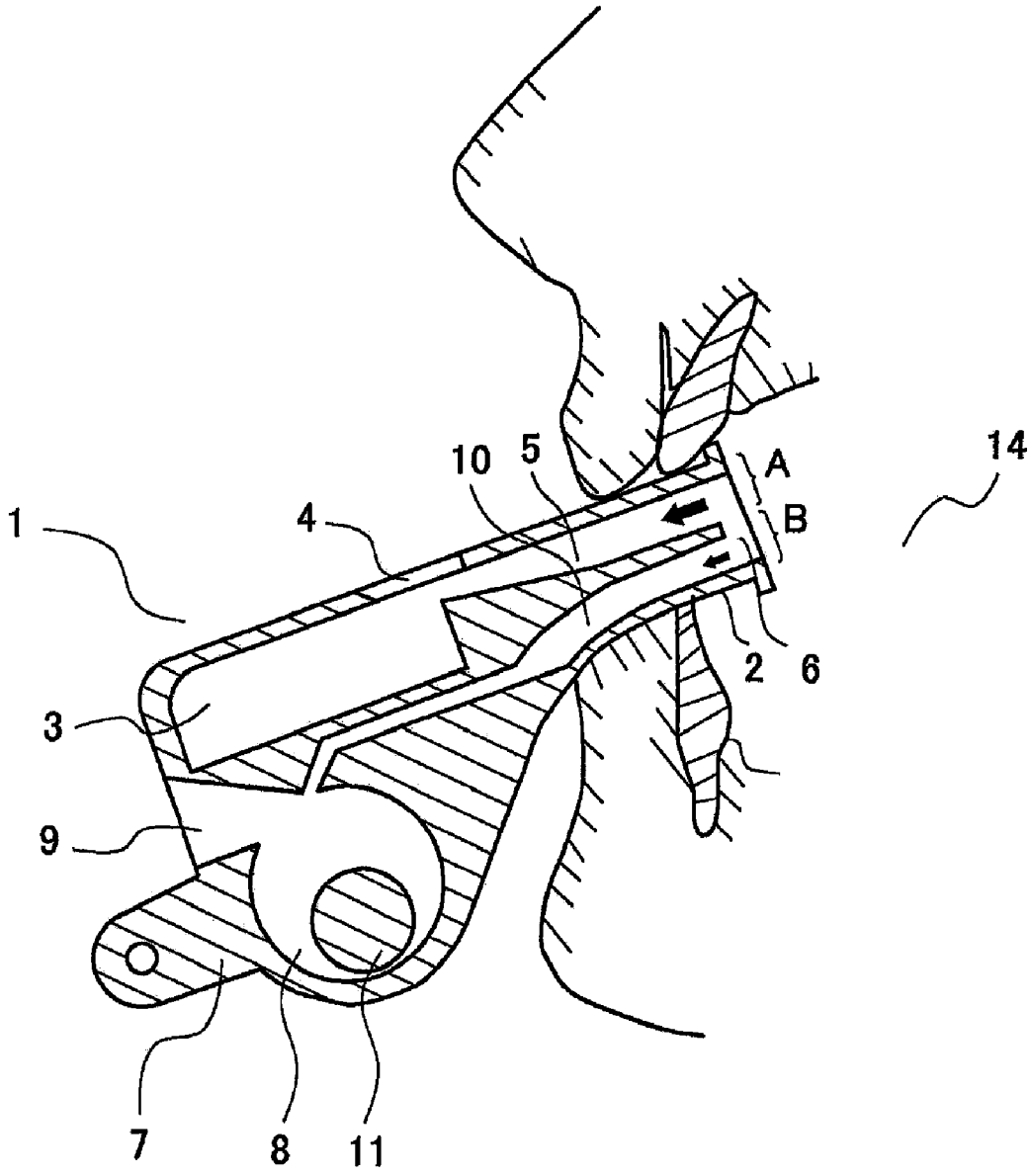
FIG. 4 is a cross-sectional view showing a sound generating condition of the whistle of the present invention.

Furthermore, according to the first embodiment, it is possible to adjust blowing of the first and second whistles A, B. That is, according to the first embodiment, the length D of the common air feeding tube 6 is set to be a length which enables separate blowing up and down, preferably, 0 to 7 mm. Accordingly, an amount of air flowing in the first air feeding tube 5 and the second air feeding tube 10 can be controlled, thereby enabling selection of tone. As is shown in FIG. 4, as the mouthpiece 2 is put in a mouth with the whistle 1 being inclined relative to a throat 14, a whistle opposite to the inclined side mainly generates sound. In the example shown in FIG. 4, the whistle 1 is inclined downwardly, so that more air is supplied into the upper first whistle A as indicated with a larger arrow, resulting in increasing of the sound volume of the non-oscillator whistle. Conversely, if the whistle 1 is inclined upwardly, the amount of air supplied into the second whistle B increases, so that the sound volume of the oscillator whistle increases. Therefore, the blown level of the whistle A, B changes depending on an angle relative to the throat 14, the tone is characterized in accordance with such a change, so that tone different from that of conventional whistles is generated, thereby overcoming the false recognition problem.

Figure 5:
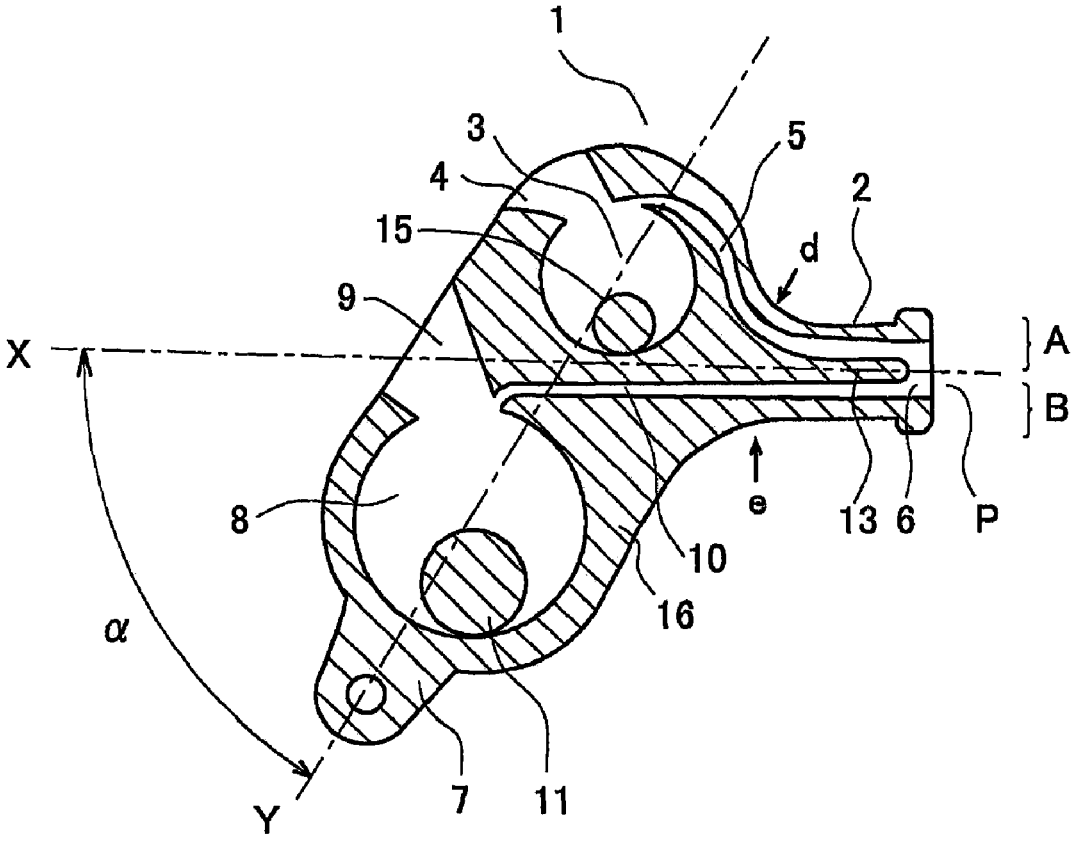
FIG. 5 is a cross-sectional view according to another embodiment of the present invention.

FIG. 5 shows a second embodiment. In the second embodiment, the upper and lower first and second whistles A, B of the two-layer structure separated by the partition wall 13 are both oscillator whistles. The first resonant chamber 3 and the second resonant chamber 8 have different cylindrical diameters, and have different volumes. Mechanical oscillators 15, 11 are inserted into respective chambers 3, 8. The mouthpiece 2 has the same structure as that of the first embodiment, so that it is possible to simultaneously blow both first and second whistles A, B, and to separately blow the whistles A, B by changing an angle relative to the throat 14 (see FIG. 4).

Because the first and second resonant chambers 3, 8 have different diameters, the resonant frequencies also differ, so that the oscillator whistles having two different kinds of tones are blown simultaneously, thereby realizing new discriminative tone. In particular, when the diameter of the first whistle A is set to be 10 to 12 mm, the resonant frequency thereof becomes close to that of a non-oscillator whistle, and beat sound is generated by the mechanical oscillator 15, thereby generating new discriminative tone.

Moreover, as is clear from FIG. 5, the orifices 4, 9 of both whistles are opened frontward, so that whistle sound is efficiently transmitted in a short time. The further characteristic point of the second embodiment is that an intersection angle $\alpha$ between a mouthpiece axis X and a resonant-chamber-body axis Y interconnecting the first resonant chamber 3 and the second resonant chamber 8 together is 30 to 75 degree, preferably, 50 to 70 degree. This allows formation of concave curved faces d, e between a resonant-chamber body 16 and the mouthpiece 2 as shown in FIG. 5. The shape thereof functions as a stopper which fits the lip of a person moderately, so that it is possible to stably put the mouthpiece 2 in a mouth. Accordingly, this is an efficient shape for sport referees who needs a rapid motion and cannot hold the whistle by a hand because of such a motion with both hands. It is apparent that this discriminative shape is realized by not only the two-layer structure of oscillator whistles, but also a two-layer structure of a non-oscillator whistle and an oscillator whistle of the foregoing embodiment, or by a normal single-layer structure.

Furthermore, by utilizing the arrangement of the second embodiment, the second whistle B in FIG. 5 can be replaced with a non-oscillator whistle (the whistle A in FIG. 2) (not illustrated). According to such a structure, an arrangement that the two-layer structure of the first embodiment (see FIG. 2) is inverted up and down, i.e., the upper part is the oscillator whistle, and the lower part is the non-oscillator whistle, is acquired. Like the second embodiment, the concave curved faces d, e can be formed in the mouthpiece 2, and this functions as a stopper, so that it becomes possible to stably put the mouthpiece 2 in a mouth. The orifices of both whistles can be opened frontward, thereby propagating whistle sound directly in a short time.

The foregoing embodiments are to realize discriminative tone using the basic structure of the whistle itself without any special member, but the following is to enhance the function of the whistle by adding another member to the basic structure of the present invention.

Figure 6:
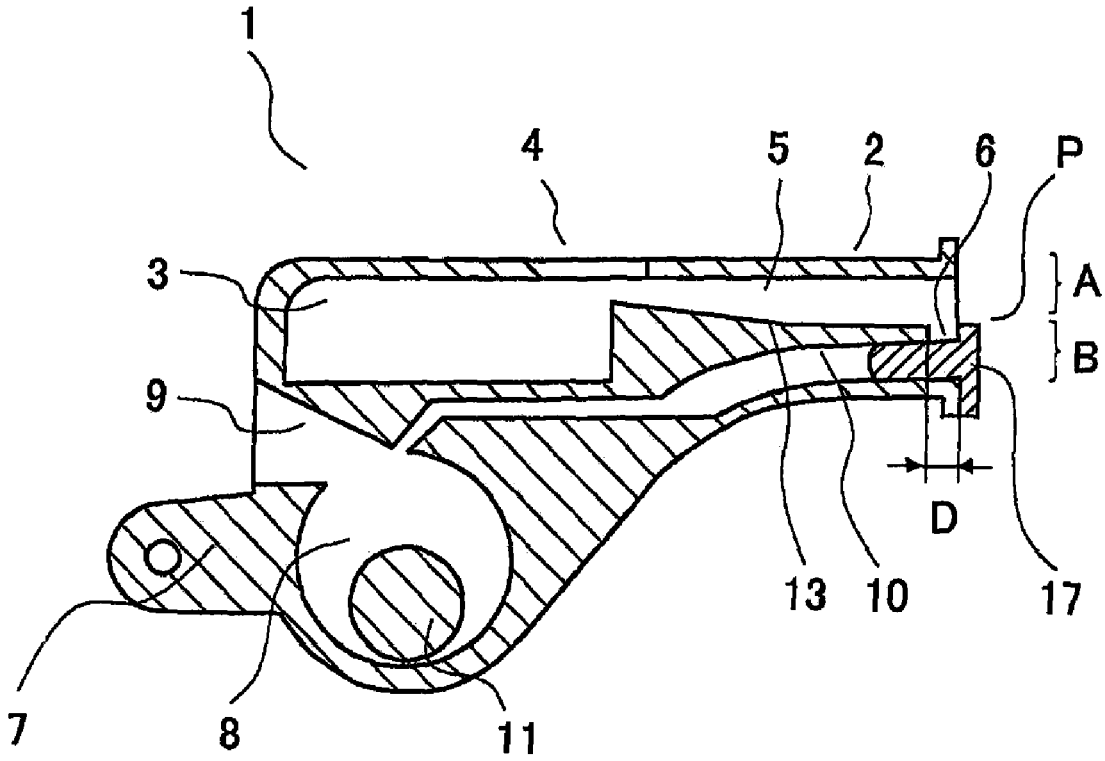
FIG. 6 is a cross-sectional view of a whistle equipped with a tone selecting member of the present invention.
Figure 7:
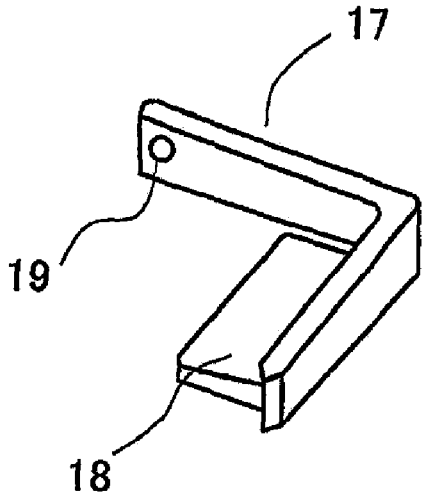
FIG. 7 is a perspective view of the tone selecting member of the present invention.

FIG. 6 shows a third embodiment in which a tone selecting member 17 is attached to the first embodiment. As shown in FIG. 7, the tone selecting member 17 has a substantially-tabular insertion plate 18 provided inwardly of an L-shaped member, and is inserted into the air feeding opening P to block either one of the air feeding tubes 5, 10. Accordingly, the insertion plate 18 has a size slightly smaller than the first and second air feeding tubes 10, 5. The L-shaped member of the tone selecting member 17 has a string hole 19 provided at another end, a string (not shown) is fitted in the string hole 19 for suppressing any falling off, and another end of the string is attached to the strap holder 7 of the main body of the whistle 1. Like the whistle 1, the tone selecting member 17 can be easily formed of a plastic injection molding technique. No air flows in the first whistle A or the second whistle B into which the tone selecting member 17 is inserted, it is not possible to blow it, so that the whistle 1 functions as a single first whistle A or second whistle B. Therefore, it is possible to easily select three kinds of tones: the first whistle A; the second whistle B; and the first whistle A and the second whistle B, through a single whistle including a case in which the tone selecting member 17 is not used. Accordingly, the false recognition problem of whistle sound in adjacent court can be solved.

Figure 8:
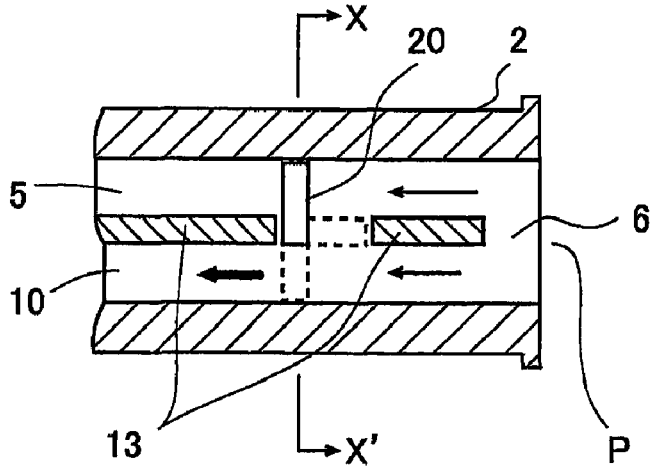
FIG. 8 is a cross-sectional view for explaining how to adjust air flow by an air amount adjusting flap of the whistle of the present invention.
Figure 9:
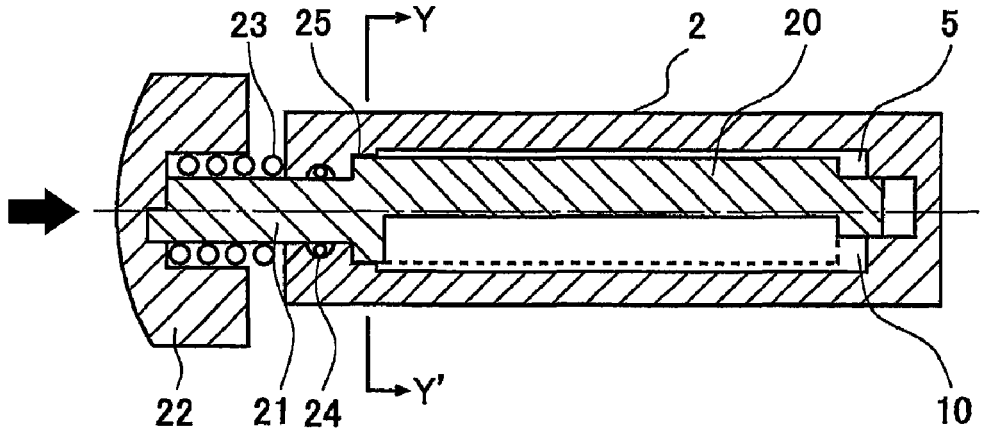
FIG. 9 is a cross-sectional view showing a structure of a whistle provided with the air amount adjusting flap of the present invention.

FIG. 8 shows a fourth embodiment which further facilitates selection of tone. A part of the partition wall 13 is cut out, and is replaced with a rotatable air amount adjusting flap 20. FIG. 9 shows an X-X' cross section thereof.

As shown in FIG. 8, the air amount adjusting flap 20 is connected to a shaft (cylinder) 21, and is a plate that a lower half part (surrounded by a dashed line) from the center of the shaft 21 is cut out, and the size thereof is slightly smaller than the first and second air feeding tubes 5, 10. The thickness thereof is substantially same as the wall thickness of a notched part of the partition wall 13. In the figure, a knob 22 is fixed to a left end of the shaft 21, and a compressed spring 23 is provided between the knob 22 and the mouthpiece 2. Accordingly, the knob 22, the shaft 21 connected thereto, and the air amount adjusting flap 20 are always pulled to the left in the figure relative to the mouthpiece 2. In the figure, the shaft 21 can be slid in the horizontal direction in shaft holes, a left shaft hole is an opened hole, and a right shaft hole is a closed hole. Hence, an O-ring 24 for suppressing any air leakage is attached in the left shaft hole. The right shaft hole does not need an O-ring.

Figure 10:
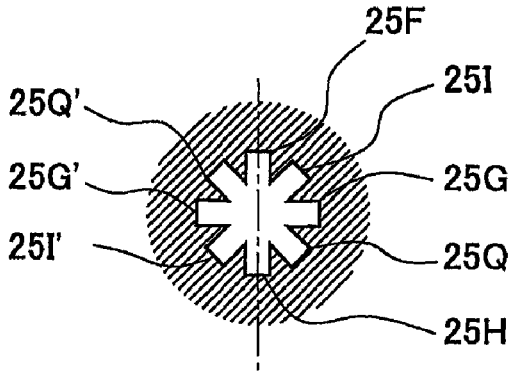
FIG. 10 is a cross-sectional view showing a structure of a fixed groove of the air amount adjusting flap of the whistle of the preset invention.

Moreover, as shown in FIG. 10, an inner wall surface (Y-Y') of the left shaft hole is formed with a flap fixing groove 25. According to such a structure, as the knob 22 is pushed in a direction of an arrow in FIG. 9, the air amount adjusting flap 20 moves to the right in the figure, so that a left end thereof is released from the flap fixing groove 25, and the air amount adjusting flap 20 becomes rotatable. In this condition, as the knob 22 is rotated and a finger is released from the knob 22 at a desired position, the shaft 21 is slid to the left, the left end of the air amount adjusting flap 20 is caught in the flap fixing groove 25, and the air amount adjusting flap 20 is thus fixed. FIG. 8 shows an example case in which the air amount adjusting flap 20 is fixed to flap fixing grooves 25F, 25H through the foregoing operation, and in this case, the first air feeding tube 5 is blocked off, flowing air all flows in the second air feeding tube 10, and as a result, only the second whistle B is blown. Conversely, when the air amount adjusting flap 25 is rotated 180 degree and fixed to the flap fixing grooves 25H, F, the second air feeding tube 10 is blocked off, and only the first whistle A is blown. Moreover, if the air amount adjusting flap 20 is fixed to flap fixing grooves 25G, G', both first and second whistles A, B are blown, and if the air amount adjusting flap 20 is fixed to flap fixing grooves 25I, 25I' or 25Q, 25Q', the air amount to the corresponding air feeding tube becomes substantially half, so that tone becomes different in comparison with a case in which the air is equally distributed. Note that in addition to the foregoing structure, conventionally well known techniques like a mechanism of a combination of a gear and a ratchet can be used as the air amount adjusting mechanism. The position where the air amount adjusting mechanism is attached is not limited to the mouthpiece, and those skilled in the art can figure out that such a mechanism can be attached any position across the whole range of the air feeding tube. According to the fourth embodiment, it requires no bothersome work like attachment of the tone selecting member, and tone can be changed easily in a short time through merely a rotating operation of the knob, so that this is especially suitable for sport referees who need a rapid motion. Note that the air amount adjusting flap 20 is not limited to the configuration of the fourth embodiment, and the same effect can be accomplished through a mechanism which controls an amount of air flowing into the individual air feeding tubes 5, 10 by changing a fed-air cutoff area of the first air feeding tube 5 and that of the second air feeding tube 10. For example, an upper wall part of the first air feeding tube 5 may be a flap, or a lower wall part of the second air feeding tube 10 may be a flap, etc. Moreover, a part of front end of the partition wall 13 may be a flap.

Figure 11:
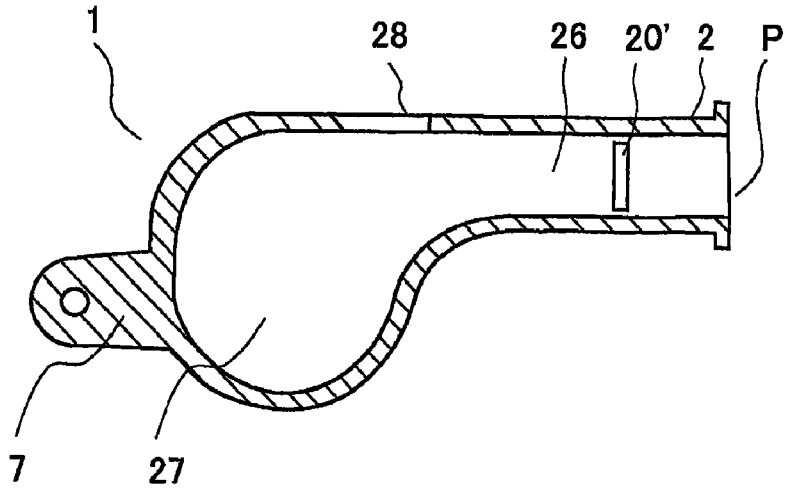
FIG. 11 is a cross-sectional view according to the other embodiment of the present invention.

Next, an explanation will be given of a fifth embodiment with reference to FIG. 11, FIG. 12, and FIG. 13. FIG. 11 shows a cross section of a whistle according to the fifth embodiment. A whistle 1 comprises a resonant chamber 27, an air feeding tube 26 for feeding air into the resonant chamber 27, an orifice 28, an air feeding opening P, and an air amount adjusting flap 20' provided in the air feeding tube 26.

In the fifth embodiment, an explanation will be given of a non-oscillator whistle, but the whistle of the fifth embodiment may be an oscillator whistle. Moreover, in the fifth embodiment, an explanation will be given of not a two-layer structure but a conventional single-layer structure in order to avoid complexity of an adjusting mechanism, but it is apparent to those skilled in the art that the principle of the fifth embodiment can be applied to a two-layer structure.

Figure 12:
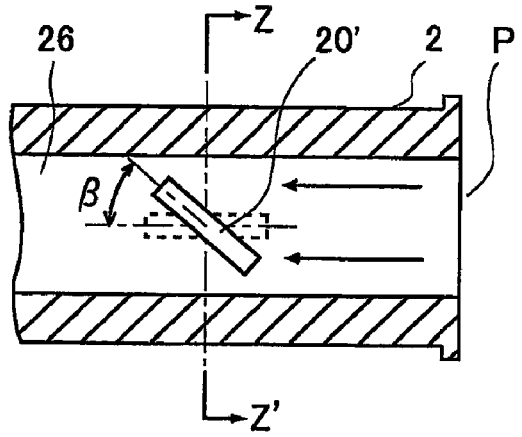
FIG. 12 is a cross-sectional view for explaining how to adjust air flow by another air amount adjusting flap of the present invention.
Figure 13:
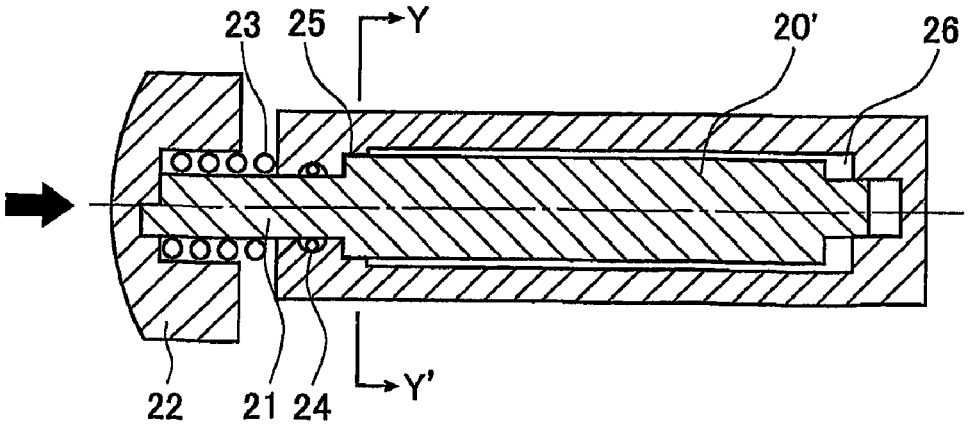
FIG. 13 is a cross-sectional view showing a structure of a whistle provided with an air amount adjusting flap of the present invention.

The air amount adjusting flap 20' is attached in the air feeding tube 26 so as to be orthogonal to the direction of airflow, and as shown in FIG. 12, the amount of air-supply is controlled by a rotating angle β. A mechanism shown in FIG. 13 can be used as the rotation and fixing mechanism of the air amount flap 20'. FIG. 13 shows a Z-Z' cross section in FIG. 12, employs substantially same structure as that of FIG. 9, and exemplifies the air amount adjusting flap 20' having no notch (dashed line part in FIG. 9). Using the flap fixing groove 25 shown in FIG. 10, as the air amount adjusting flap 20' is fixed to flap fixing grooves 25F, 25H, the air feeding tube 26 can be blocked off at maximum. However, the size of the air amount adjusting flap 20' and the shape thereof are not limited to any particular ones if those can block off the air-supply cross-sectional area of the air feeding tube 26, and various shapes and the like can be employed. The air amount adjusting flap 20' is not limited to the fifth embodiment, and any mechanism which changes the air-supply cross-sectional area and controls the air amount flowing into the resonant chamber 27 can accomplish the same effect. For example, an upper wall part of the air feeding tube 26 or a lower wall part thereof may be structured as a flap.

Regarding how to make the air feeding amount variable, in addition to the foregoing air amount adjusting flap 20', either the air feeding tube P or the orifice 28 may be provided with a slidable plate or the like, and an area through which air passes may be made variable by means of such a plate or the like.

According to the present invention, the area of the air feeding tube 26 is set to be 90 $mm^2$ which is larger than conventional one (in general, the air feeding tube becomes narrow toward the resonant chamber, but the air feeding tube 26 is so formed as to have a uniform and same size as that of the air feeding opening for simplification of the explanation), and can be adjusted between 40 to 90 $mm^2$ by the air amount adjusting flap 20'.

When the air amount adjusting flap 20' is selectively fixed to flap fixing grooves 25G, 25G' (see FIG. 10), the effective air-supply area becomes maximum (90 $mm^2$), i.e., becomes the maximum air feeding amount, so that the loudest sound volume can be acquired.

Figure 14:
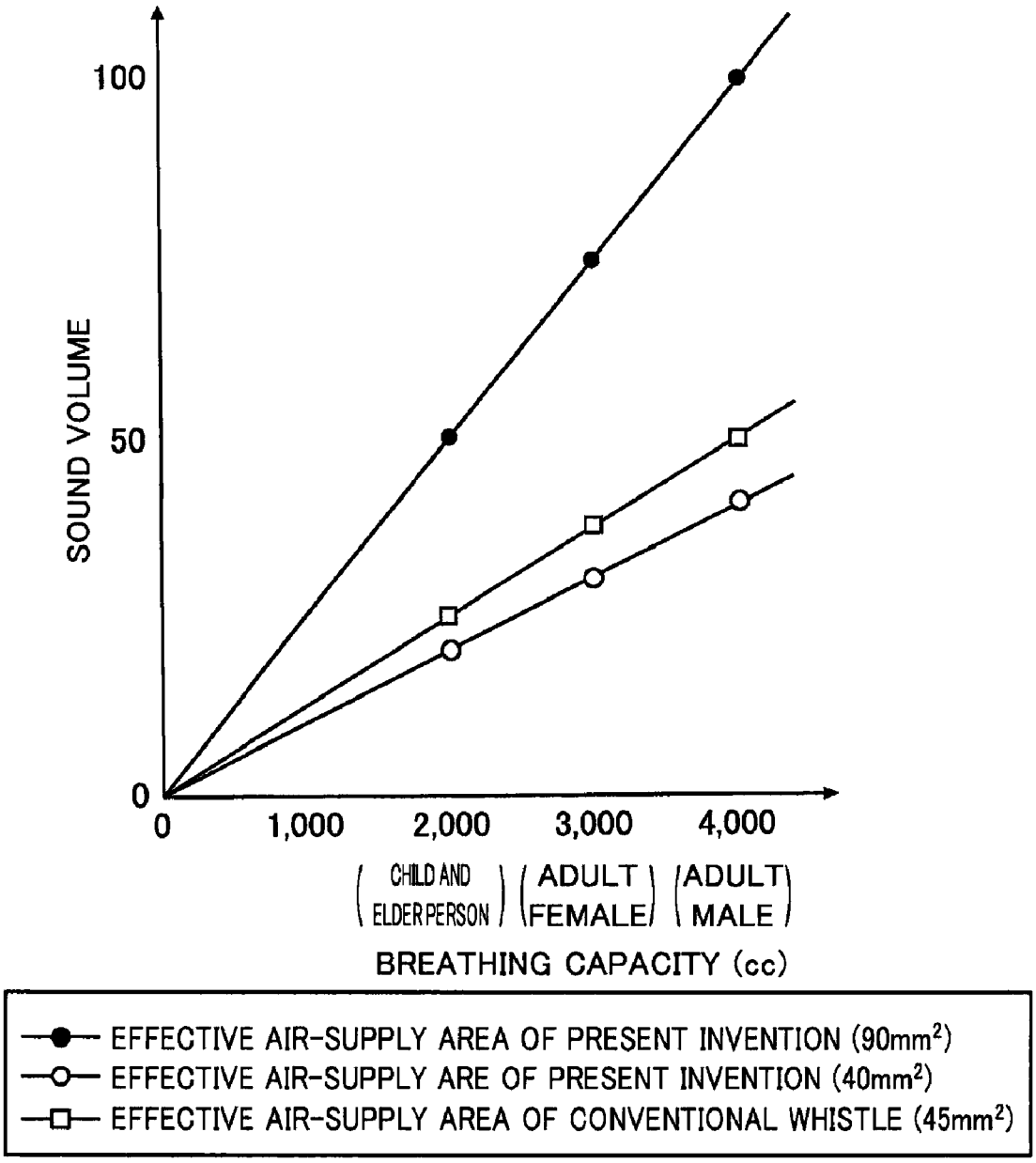
FIG. 14 is a diagram showing a relationship between a sound volume and a breathing capacity.
Figure 15:
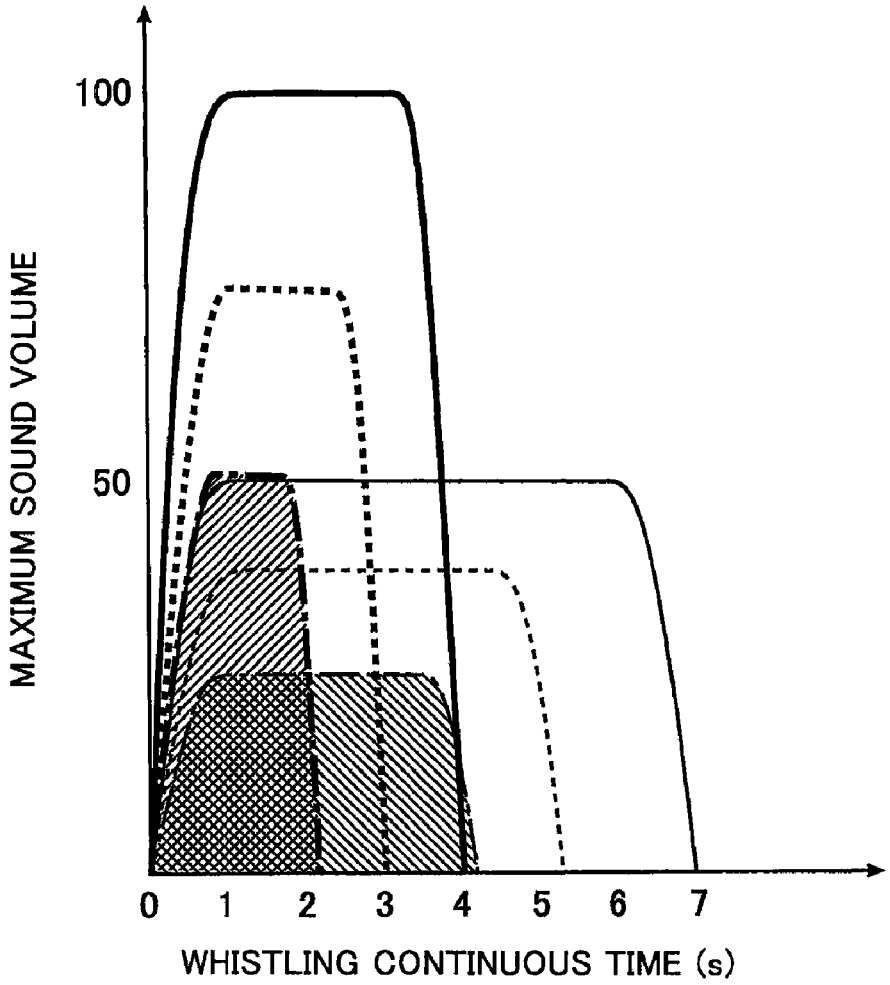
FIG. 15 is a diagram showing a relationship between a sound volume and a whistling continuous time.

FIG. 14 shows a relationship between a breathing capacity and a sound volume for a case when the effective air-supply area of the whistle of the present invention is maximum (90 $mm^2$), a case when minimum (40 $mm^2$), and a case of an effective air-supply area (45 $mm^2$) of a conventional whistle. FIG. 15 shows a relationship between the maximum sound volume and a whistling continuous time for a case when the effective air-supply area of the whistle of the present invention is maximum (90 $mm^2$), and a case of the effective air-supply area (45 $mm^2$) of a conventional whistle. Note that a sound volume is a relative value in both figures.

In the case of an adult male, a general breathing capacity is 4000 cc or so, and as shown in FIG. 14, when it is assumed that a whistling sound volume in a case in which the whistle of the present invention is used and the effective air-supply area thereof is maximum (90 $mm^2$) is 100, in the case of the conventional and general whistle, it becomes 50 or so because the effective air-supply area is half. Therefore, in comparison with the conventional whistle, it is possible to blow the whistle of the present invention with a lauder sound volume twice as much as that of the conventional one.

At this time, as is clear from FIG. 15, in the case of an adult male, the whistling continuous time is seven seconds for the conventional whistle, but is about four seconds for the whistle of the present invention and is short. The whistling continuous time is set based on the breathing capacity and the air feeding amount per unit time, and the larger the effective air-supply area is, the larger the air feeding amount per unit time becomes. When the effective air-supply area of the present invention is made maximum, the air feeding amount per unit time becomes large, so that the whistling continuous time becomes short. It is exemplified in FIG. 15, but an area surrounded by a sound volume and a horizontal axis becomes same for adult males with each other, adult females with each other, and children and elder people with each other if the breathing capacity remains same (e.g., regarding an example case of children and elder people, two areas surrounded by inclined lines are same).

However, it is not necessary that the whistling continuous time of the maximum sound volume is long, four seconds or so is a sufficient time to transmit information, and it is a rare case in which a whistle is blown for a longer time than that in practice. Accordingly, there is no problem in practical use, and because the maximum air feeding amount per unit time becomes twice as much as that of the conventional whistle, the maximum sound volume which is remarkably increased is acquired. The maximum sound volume is made variable and remarkably increased as the air amount passing through the air feeding tube is made variable and the maximum air feeding amount per unit time is made variable.

The present invention further realizes a remarkable characteristic which cannot be accomplished by the conventional technologies. That is, because the breathing capacity largely varies based on a gender, an age, and an individual difference, this is an obstruction at the time of purchasing. Because a whistle is used while being put in a mouth, it is difficult to do trial at the time of purchasing, and a whistle is sold while encapsulated in a package for suppressing any contamination. Accordingly, a problem may occur that a whistle does not match a breathing capacity of a user after purchasing, and the user feels it is hard to breathe. According to the present invention, if the number of flap fixing grooves 25 (see FIG. 10) is increased, the user can select an air-supply area which is proper for his/her own breathing capacity, so that the foregoing problem can be solved.

As explained above, the present invention has a function of adjusting the amount of flowing air, thereby realizing discriminative and new tone, and dramatically increasing the sound volume. Thus, various problems of conventional whistle can be eliminated, and the function of whistle can be remarkably enhanced.

According to the present invention, because the first and second whistles are stacked in the vertical direction so as to be integrated together, it is possible to supply air into individual resonant chambers at the same time, thereby enabling blowing of two kinds of whistles simultaneously. As the first orifice is opened upwardly and the second orifice is provided opposite to the air feeding opening, sound waves are directly and instantaneously transmitted from the second orifice to a listener. Because sound waves are directly transmitted, it is possible to suppress any attenuation of a whistling sound volume, resulting in transmission of sound waves with a larger sound volume.

According to the present invention, the first resonant chamber and the second resonant chamber have different volumes, and both resonant chambers contain respective oscillators. Because the first resonant chamber and the second resonant chamber have different volumes, respective resonant frequencies becomes different from each other, so that it is possible for a user to simultaneously blow two kinds of mechanical oscillator whistles with different tones as a whole. Because both orifices are opened frontward, sound waves can be directly and instantaneously transmitted to a listener with a larger sound volume while suppressing any attenuation of the whistle sound.

Moreover, according to the present invention, the resonant-chamber-body axis is inclined relative to the mouthpiece axis, the first resonant chamber is provided at the air feeding opening side, and the mouthpiece is formed in a concaved shape, so that the mouthpiece can fit a lip when being put in a mouth and functions as a stopper. This makes it possible for sport referees who need a rapid motion to put the whistle in a mouth instantaneously and stably, and to blow the whistle as quick as possible.

Furthermore, according to the present invention, because the first resonant chamber of the non-oscillator whistle comprises a plurality of resonant chambers, it is possible to generate plural different frequency sounds which are richer and deeper annunciation sounds.

Still further, according to the present invention, the first air feeding tube and the second air feeding tube are separated in the vertical direction by the partition wall, a distance from the air feeding opening to the partition wall is set to be 0 to 7 mm, and an amount of air flowing into the first air feeding tube and the second air feeding tube can be changed depending on an angle. Accordingly, the amount of air flowing into the first air feeding tube and the second air feeding tube can be controlled depending on an angle how to put the mouthpiece in a mouth even if the whistles are blown uniformly, so that it is possible for a user to blow a single whistle as a whole while selecting various tones.

Yet further, according to the present invention, because the air feeding opening is provided with a detachable tone selecting member, as the tone selecting member is attached in such a manner as to block off the first air feeding tube or the second air feeding tube, it becomes possible for a user to blow the whistle while easily selecting the tone of the mechanical oscillator whistle or the tone of the non-oscillator whistle.

According to the present invention, the rotatable air amount adjusting flap is provided as a part of the partition wall separating the first air feeding tube and the second air feeding tube from each other. As the air amount adjusting flap is rotated, the first air feeding tube or the second air feeding tube can be easily blocked off, thereby realizing blowing of the whistle while selecting the tone of the mechanical oscillator whistle or the tone of the non-oscillator whistle.

According to the present invention, the air feeding tube is provided with the rotatable air amount adjusting flap. As the air amount adjusting flap is rotated, an amount of air blown into the resonant chamber can be controlled. Therefore, it is possible for a user to select an air-supply area appropriate for a breathing capacity of individual user, such as a male, a female, a child, or the like. Hence, it is possible for the user to blow the whistle with a large sound volume depending on individual user.

The invention claimed is:

1. A whistle comprising:

a first whistle including a first resonant chamber, a first air feeding tube for feeding air into the first resonant chamber, and a first orifice;

a second whistle including a second resonant chamber, a second air feeding tube for feeding air into the second resonant chamber, an oscillator configured to swivel and provided in the second resonant chamber, and a second orifice; and an air feeding opening for feeding air into the first air feeding tube and the second air feeding tube, wherein the first whistle is arranged above the second whistle and integrated together regardless of a positional relationship so as to stack the first air feeding tube and the second air feeding tube up and down to form a mouthpiece, and the first orifice is opened upwardly and the second orifice is opened toward an opposite side to the air feeding opening.

2. The whistle according to claim 1, wherein a resonant-chamber-body axis interconnecting the first resonant chamber and the second resonant chamber is inclined relative to a mouthpiece axis of a mouthpiece parallel to the first air feeding tube and the second air feeding tube, and the first resonant chamber is located at the air feeding opening side to form the mouthpiece in a concaved shape, thereby causing the mouthpiece to function as a stopper against a lip.

3. The whistle according to claim 1, wherein an amount of air flowing into the first air feeding tube and the second air feeding tube is controlled depending on an angle of putting a mouthpiece including the first air feeding tube and the second air feeding tube into a mouth to select timbre.

4. The whistle according to claim 1, further comprising a timbre selecting member which is detachable and which blocks off the first air feeding tube or the second air feeding tube, wherein timbre is selected by causing the timbre selecting member to block off air flowing into either one of the first air feeding tube and the second air feeding tube.

5. The whistle according to claim 1, further comprising an air amount adjusting flap which changes air-supply cross-sectional areas of the first air feeding tube and the second air feeding tube to control an amount of air flowing into the first air feeding tube and the second air feeding tube.

* * * * *